US011008781B2

(12) United States Patent
Long et al.

(10) Patent No.: US 11,008,781 B2
(45) Date of Patent: May 18, 2021

(54) TYPE OF PADLOCK

(71) Applicant: PURIMEE QIANHAI (SHENZHEN) INTELLIGENT TECHNOLOGY CO., LTD., Shenzhen (CN)

(72) Inventors: Licai Long, Shenzhen (CN); Hai Li, Shenzhen (CN); Zhihong Luo, Shenzhen (CN)

(73) Assignee: PURIMEE QIANHAI (SHENZHEN) INTELLIGENT TECHNOLOGY CO., LTD., Shenzhen (CN)

( * ) Notice: Subject to any disclaimer, the term of this patent is extended or adjusted under 35 U.S.C. 154(b) by 148 days.

(21) Appl. No.: 16/181,919

(22) Filed: Nov. 6, 2018

(65) Prior Publication Data

US 2019/0226242 A1 Jul. 25, 2019

(51) Int. Cl.

| | |
|---|---|
| ***E05B 67/00*** | (2006.01) |
| ***E05B 15/04*** | (2006.01) |
| ***E05B 67/22*** | (2006.01) |
| ***E05B 47/06*** | (2006.01) |
| ***E05B 47/00*** | (2006.01) |
| ***G07C 9/00*** | (2020.01) |
| *E05B 35/00* | (2006.01) |

(52) U.S. Cl.

CPC ..... *E05B 67/003* (2013.01); *E05B 15/04* (2013.01); *E05B 47/0012* (2013.01); *E05B 47/0603* (2013.01); *E05B 67/22* (2013.01); *G07C 9/00563* (2013.01); *E05B 2035/009* (2013.01)

(58) Field of Classification Search

CPC ..... E05B 67/003; E05B 15/04; E05B 67/22; E05B 47/0603; E05B 47/0012; E05B 2035/009; E05B 67/006; E05B 2015/0413; E05B 67/063; E05B 67/10; E05B 67/18; G07C 9/00563

USPC ..... 70/14, 18, 30, 49, 53, 58, 38 R, 38 A, 70/38 B, 38 C, 233, 277, 278.1, 278.7, 70/279.1, 280–282

See application file for complete search history.

(56) References Cited

U.S. PATENT DOCUMENTS

| | | | |
|---|---|---|---|
| 6,675,673 | B2 | 1/2004 | Starken |
| 7,051,561 | B2 | 5/2006 | Moon et al. |
| 8,302,438 | B2 | 11/2012 | Lui |
| 8,353,187 | B2 | 1/2013 | Woodling |
| 8,671,723 | B2 | 3/2014 | Dayanikli et al. |
| 8,800,402 | B2 | 8/2014 | Weum |
| 8,850,858 | B2 | 10/2014 | Nave |
| 9,850,685 | B2 | 12/2017 | Dore Vasudevan et al. |
| 9,982,462 | B2 | 5/2018 | Lin et al. |

(Continued)

*Primary Examiner* — Lloyd A Gall

(74) *Attorney, Agent, or Firm* — Miles & Stockbridge P.C.

(57) ABSTRACT

A padlock comprises a bolt unit having a stopper, a brake unit being moveable up-and-down, and a drive unit for driving the movement of the brake unit. The drive unit includes a drive motor and a driving cap fixedly sleeved on a drive lever. The driving cap includes a lug boss. The brake unit includes a first spring fixedly connected to a tumbler. The spacing of the coils of the first spring matches the lug boss such that the lug boss can move inside or outside of a threaded gap thereof. After the padlock is locked or unlocked, even if the drive lever continues to rotate, the lug boss just moves out of the first spring and may not drive the first spring to move up or down. Thus, the tumbler stops moving up or down and will not generate a pressure on the internal structure of the padlock.

4 Claims, 4 Drawing Sheets

(56) References Cited

U.S. PATENT DOCUMENTS

| | | | | |
|---|---|---|---|---|
| 10,400,481 | B2 * | 9/2019 | Wong | E05B 47/00 |
| 10,422,163 | B1 * | 9/2019 | Cabral Herrera | E05B 67/22 |
| 10,428,557 | B2 * | 10/2019 | Niroomand | G07C 9/00182 |
| 10,458,153 | B2 * | 10/2019 | Nguyen | E05B 67/10 |
| 2006/0075793 | A1 * | 4/2006 | Yu | E05B 37/025 70/30 |
| 2007/0126551 | A1 * | 6/2007 | Slevin | E05B 67/00 340/5.53 |
| 2010/0083713 | A1 * | 4/2010 | Woodling | E05B 47/0603 70/22 |
| 2011/0041570 | A1 * | 2/2011 | Huang | E05B 37/0034 70/21 |
| 2013/0055773 | A1 * | 3/2013 | Li | G07C 9/0069 70/278.1 |
| 2015/0204110 | A1 | 7/2015 | Boutelegier | |
| 2017/0009491 | A1 * | 1/2017 | Nguyen | G07C 9/00944 |
| 2018/0051483 | A1 * | 2/2018 | Yuan | E05B 47/0603 |
| 2018/0075679 | A1 * | 3/2018 | Niroomand | E05B 47/0603 |
| 2018/0119452 | A1 | 5/2018 | Dore Vasudevan et al. | |
| 2018/0209174 | A1 * | 7/2018 | Ho | G07C 9/00174 |
| 2019/0156607 | A1 * | 5/2019 | Tao | E05B 67/22 |
| 2019/0226242 | A1 * | 7/2019 | Long | E05B 15/04 |
| 2019/0344849 | A1 * | 11/2019 | Weiershausen | E05B 47/0012 |
| 2019/0383057 | A1 * | 12/2019 | Larson | E05B 67/063 |

* cited by examiner

TYPE OF PADLOCK

CROSS-REFERENCE TO RELATED APPLICATIONS

This application claims the benefit of priority to Chinese Patent Application No. 201820141781.X entitled "A Type of Padlock," filed on Jan. 23, 2018, Chinese Patent Application No. 2018/10818922.1 entitled "A Fingerprint Padlock," filed on Jul. 24, 2018, and Chinese Patent Application No. 201821176170.5 entitled "A Fingerprint Padlock," filed on Jul. 24, 2018. The entire contents and disclosures of these patent applications are incorporated herein by reference in their entirety.

BACKGROUND

Field of the Invention

The embodiments of the present invention generally relate to the technology field of padlock, and more particularly, to an electronic padlock.

Background Art

With the development of electronic technology, padlocks are rapidly transformed from full-mechanical structures to electronic structures. The existing technology features of an electronic padlock generally include a lock body, a U-shaped latch hook, and an electronic lock cylinder disposed in the lock body. The electronic lock cylinder includes a motor; locking and unlocking the padlock is controlled by the rotation of the motor.

However, when a padlock with existing technology is locked or unlocked, generally, there is a "dead point," namely because the process time of locking or unlocking is short, the motor of the padlock can't be turned off in time, and the motor will still keep running even after the padlock has been locked or unlocked, which will generate a pushing pressure against the internal structure of the electronic lock cylinder. Therefore, the padlock with existing technology, when being used, will not be fully locked if the motor is turned off too early; or will generate a pushing pressure against the internal structure of the electronic lock cylinder if the motor is turned off too late. Accordingly, the padlock with existing technology is very inconvenient and unreliable, and the electronic lock cylinder of the padlock is easy to be damaged, which will increase the cost of usage.

SUMMARY

According to first broad aspect, the present invention provides a padlock comprising a lock body and a U-shaped latch hook. The latch hook includes a long lock lever and a short lock lever. The lock body has a long blind hole and a short blind hole, and the long lock lever being disposed inside of the long blind hole; the short lock lever being loosely inserted into the short blind hole, a lock slot being disposed on the left side of the short lock lever. A bolt unit, a brake unit being able to move up-and-down, and a drive unit being able to drive the brake unit to move up-and-down are disposed inside the lock body. The bolt unit is configured to be able to automatically rebound after being compressed to the left end, the left end of the bolt unit being fixed on the internal side of the lock body, the right end of the bolt unit being configured to hang in the air and to be able to engage with the lock slot; and the bolt unit having a stopper curved downward. The drive unit comprises a drive motor and a driving cap, and the drive motor has a drive lever being able to rotate clockwise and counter-clockwise; the driving cap fixedly sleeved on the drive lever, and a lug boss being disposed on the external side of the driving cap. The brake unit includes a first spring sleeved on the driving cap and a tumbler fixedly connected to the first spring; the spacing of the first spring matching the lug boss, so that the lug boss is able to move inside or outside a threaded gap of the first spring; the tumbler being located to the left side of the stopper and cooperating with the stopper to limit displacement based on a rotation of the drive lever, the distance between the lug boss and an upper end and/or a lower end of the driving cap being greater than the length of the first spring.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention. The drawings will be used for the details of this utility model; however, the embodiment in the drawings shall not be any limitation to this utility model.

DETAILED DESCRIPTION OF THE EMBODIMENTS

Figure 1:
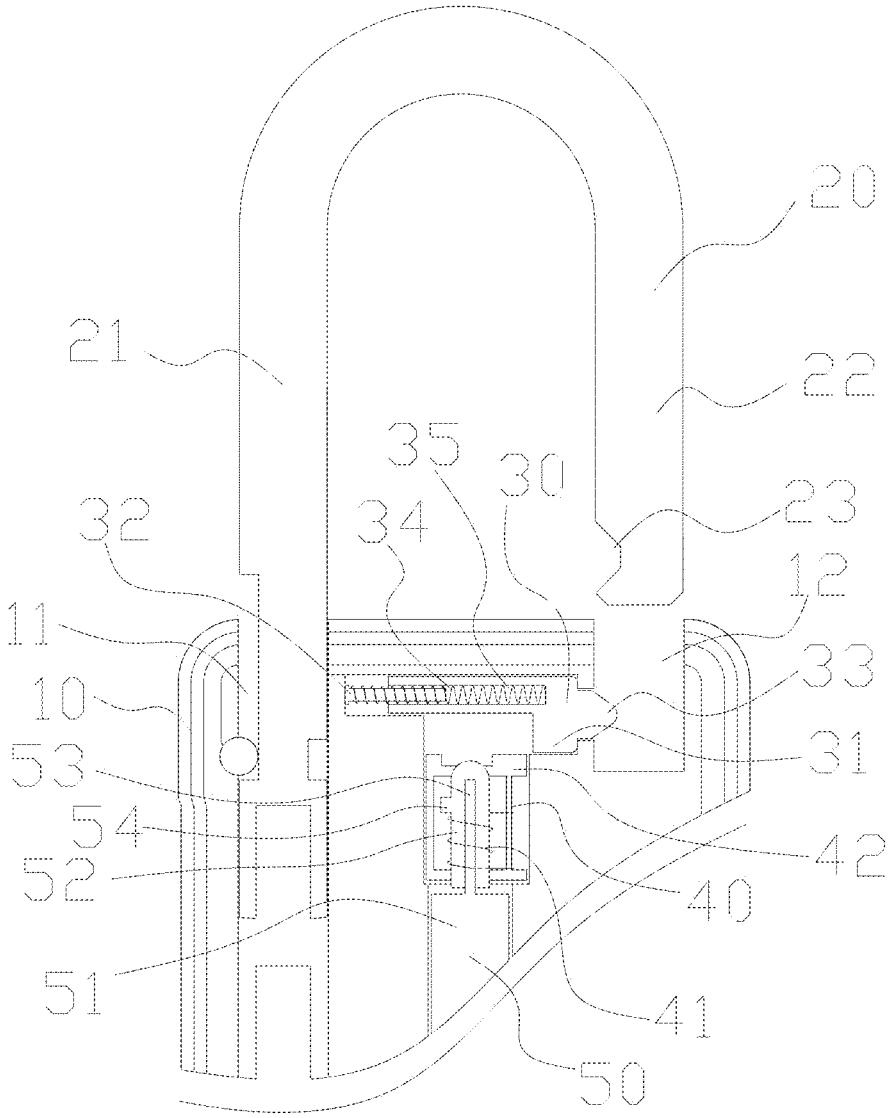
FIG. 1 is a schematic structural diagram showing an exemplary padlock in unlocked situation according to one embodiment of the present invention.

While the invention is susceptible to various modifications and alternative forms, specific embodiment thereof has been shown by way of example in the drawings and will be described in detail below. It should be understood, however that it is not intended to limit the invention to the particular forms disclosed, but on the contrary, the invention is to cover all modifications, equivalents, and alternatives falling within the spirit and the scope of the invention.

With a purpose to avoid the shortcomings in the existing technologies, embodiments of the present invention provide a padlock that is convenient to use, has no "dead point," is not easy to be damaged, is reliable and durable, and has low use cost.

A padlock disclosed herein includes a lock body and a U-shaped latch hook. The latch hook includes a long lock lever and a short lock lever. The lock body has a long blind hole and a short blind hole. The long lock lever is disposed inside the long blind hole, and the short lock lever is loosely inserted into the short blind hole. The left side of the end portion of the short lock bar is provided with a lock slot. A bolt unit is disposed inside the lock body, which is able to automatically rebound after being compressed to the left end. The left end of the bolt unit is fixed inside the lock body, and its right end is hung in the air and is able to clip or be engaged in the lock slot. The bolt unit has a convex stopper curved downward. The lock body has a brake unit being able to move up-and-down and a drive unit being able to drive the brake unit to move up-and-down. The drive unit includes a drive motor and a driving cap. The drive motor has a drive lever that is able to rotate clockwise and counter-clockwise. The driving cap is fixedly sleeved on the drive lever, and a lug boss is disposed on the external side of the driving cap; the brake unit includes a first spring sleeved on the driving cap and a tumbler fixedly connected to the first spring. The space between adjacent coils of the first spring matches the lug boss, the lug boss being movable inside or outside of a threaded gap of the first spring. The tumbler locates to the left side of the stopper and cooperates with the stopper to limit displacement based on the rotation of the drive lever; the distance between the lug boss and the upper end and the distance between the lug boss and the lower end of the driving cap are both longer than the length of the first spring.

Preferably, above said bolt unit includes a pilot, a bolt, and a second spring sleeved outside the pilot; the left end of the pilot is fixed on the internal side of the lock body, and the right end is hung in the air; the left end of the bolt has a mounting slot cooperating with the pilot; the second spring has a length greater than that of the pilot; and the pilot and the second spring are inserted into the mounting slot.

Preferably, above said tumbler is a shell-type tumbler sleeved outside the driving cap.

Preferably, the right end of above said lock bolt is arrow-head in shape, and the longitudinal section of the lock slot is also arrow-head in shape matching the shape of the lock bolt's right side.

Compared with the existing technology, embodiments of the present invention provides the following advantages: the padlock disclosed herein has a bolt unit disposed inside the lock body, which is able to automatically rebound after being compressed to the left end; a brake unit being able to move up-and-down; and a drive unit being able to drive the brake unit to move up-and-down.

During locking the padlock, the U-shaped latch hook is pressed downward from the top; the short lock lever is subsequently inserted into the short blind hole; and then the end of the short lock lever contacts the right end of the bolt unit. Due to the depression of the short lock lever, the bolt unit is able to be compressed to the left end. The short lock lever may continue to move downward. When the right side of the bolt unit and the lock slot of the short lock lever reach a same horizontal level, the bolt unit is rebound to the right side due to the bolt unit's automatic rebound feature, and the right end of the bolt unit is able to be engaged into the lock slot. At this time, the drive motor starts to run and drive the drive lever to rotate clockwise, which will cause the driving cap and the lug boss on its top to rotate clockwise. Because the space between two adjacent coils of the first spring matches the lug boss, the lug boss is able to move inside or outside the threaded gap of the first spring; when the driving cap rotates, the first spring moves upward due to the rotation of lug boss, and the tumbler connected to the first spring also moves upward. When the tumbler moves to the left side of the stopper, because the distance between the lug boss and the upper end of the driving cap is greater than the length of the first spring, the lug boss may just rotate out of the first spring. Since the stopper is limited by the displacement-limit function of the tumbler, the bolt unit is unable to keep moving leftward and will be restrained in the lock slot of the short lock lever, which means the padlock is locked. If a user fails to turn off the motor in time when the tumbler is in place, even though the drive lever still keeps rotating clockwise, since the lug boss just rotates out of the first spring, the drive lever is unable to continue to drive the first spring to move upward. Therefore, the tumbler will not continue to move upward and will not press the internal structures of the padlock.

During unlocking the lock, the drive motor starts to run and drive the drive lever to rotate counter-clockwise, which may cause the driving cap and the lug boss on the top thereof to rotate in the same counter-clockwise direction. Because the space between adjacent coils of the first spring matches the lug boss, the lug boss is able to move inside or outside the threaded gap of the first spring. When the driving cap rotates, the first spring may move downward due to the rotation of the lug boss, and the tumbler connected to the first spring may move downward. Because the distance between the lug boss and the lower end of driving cap is greater than the length of the first spring, the lug boss will just rotate out of the first spring when the tumbler exactly arrives at the position far from the left side of the stopper, and the bolt unit will be able to move leftward accordingly. At this time, when a user pulls up the U-shaped latch hook, the bolt unit will move leftward due to the thrust action from the lock slot, and the short lock lever will be pulled out of the short blind hole. Afterwards, the bolt unit will automatically rebound to the right and the padlock is unlocked. If a user does not turn off the motor in a timely manner when the padlock is unlocked and the tumbler is in its proper position, even though the drive lever will continue to rotate counter-clockwise, since the lug boss just turns out of the first spring, the tumbler is unable to keep moving downward and is unable to continually drive the first spring to move downward. Therefore, the tumbler is unable to press the internal structure of the padlock.

In some embodiments, the padlock is a type of fingerprint padlock. The fingerprint padlock comprises the above described elements and further comprises a fingerprint unit. The fingerprint unit is configured to detect whether a fingerprint of a user is matched or not, and to send an unlocking instruction to the drive unit to drive the brake unit to move when the fingerprint of the user is matched.

The above described fingerprint padlock may further comprise a lock detecting unit configured to detect whether the bolt is engaged in the lock slot.

This novel practical padlock disclosed herein is convenient to use. After a process of locking or unlocking is completed, if a user fails to turn off the motor in a timely manner while the tumbler is in place, even though the drive lever may continue to rotate, since the lug boss just rotates out of the first spring, it is unable to continually drive the first spring to move up or down, and the tumbler may not keep moving up or down. Therefore, the tumbler is not able to press the internal structure of the padlock, and then there is no "dead point" formed. Because of this feature, the internal structure of padlock is not easy to be damaged, and the padlock is reliable and durable, and has low cost of use.

According to the embodiment and the drawings, this utility model shall be further described as below.

FIGS. 1-4 illustrate a type of padlock in an exemplary configuration, according to one embodiment of the present invention. As shown in FIGS. 1-4, a padlock described herein includes a lock body 10 and a U-shaped latch hook 20. The latch hook 20 includes a long lock lever 21 and a short lock lever 22. The lock body 10 has a long blind hole 11 and a short blind hole 12. The long lock lever 21 is disposed inside the long blind hole 11, and the short lock lever 22 is loosely inserted into the short blind hole 12. A lock slot 23 is disposed on the left side of the short lock lever 22.

Inside the lock body 10 include a bolt unit 30, a brake unit 40, and a drive unit 50. The bolt unit 30 comprises a bolt 33 that can automatically rebound after being compressed to the left end of the bolt unit 30. The left end of the bolt unit 30 is fixed on the internal structure of the lock body 10, and its right end is hung in the air and is able to be engaged or clip in the lock slot 23. The bolt unit 30 has a stopper 31 that is convex. The brake unit 40 can move up-and-down. The drive unit 50 can drive the brake unit 40 to move up-and-down. The drive unit 50 includes a drive motor 51 and a driving cap 52, and the drive motor 51 has a drive lever 53 being able to rotate clockwise and counter-clockwise. The driving cap 52 is fixedly sleeved on the drive lever 53, and a lug boss 54 is disposed on the external side of the driving cap 52. The brake unit 40 includes a first spring 41 sleeved on the driving cap 52 and a tumbler 42 fixedly connected to the first spring 41. The space between adjacent coils of the first spring 41 matches the lug boss 54, so that the lug boss 54 is able to move inside or outside of the threaded gap of the first spring 41. The tumbler 42 is located left to the stopper 31 and cooperates with the stopper 31 to limit the displacement based on the rotation of the drive lever 53. The distance between the lug boss 54 and the upper end of the driving cap 52 and the distance between the lug boss 54 and the lower end of the driving cap 52 are both greater than the length of the first spring 41.

Figure 2:
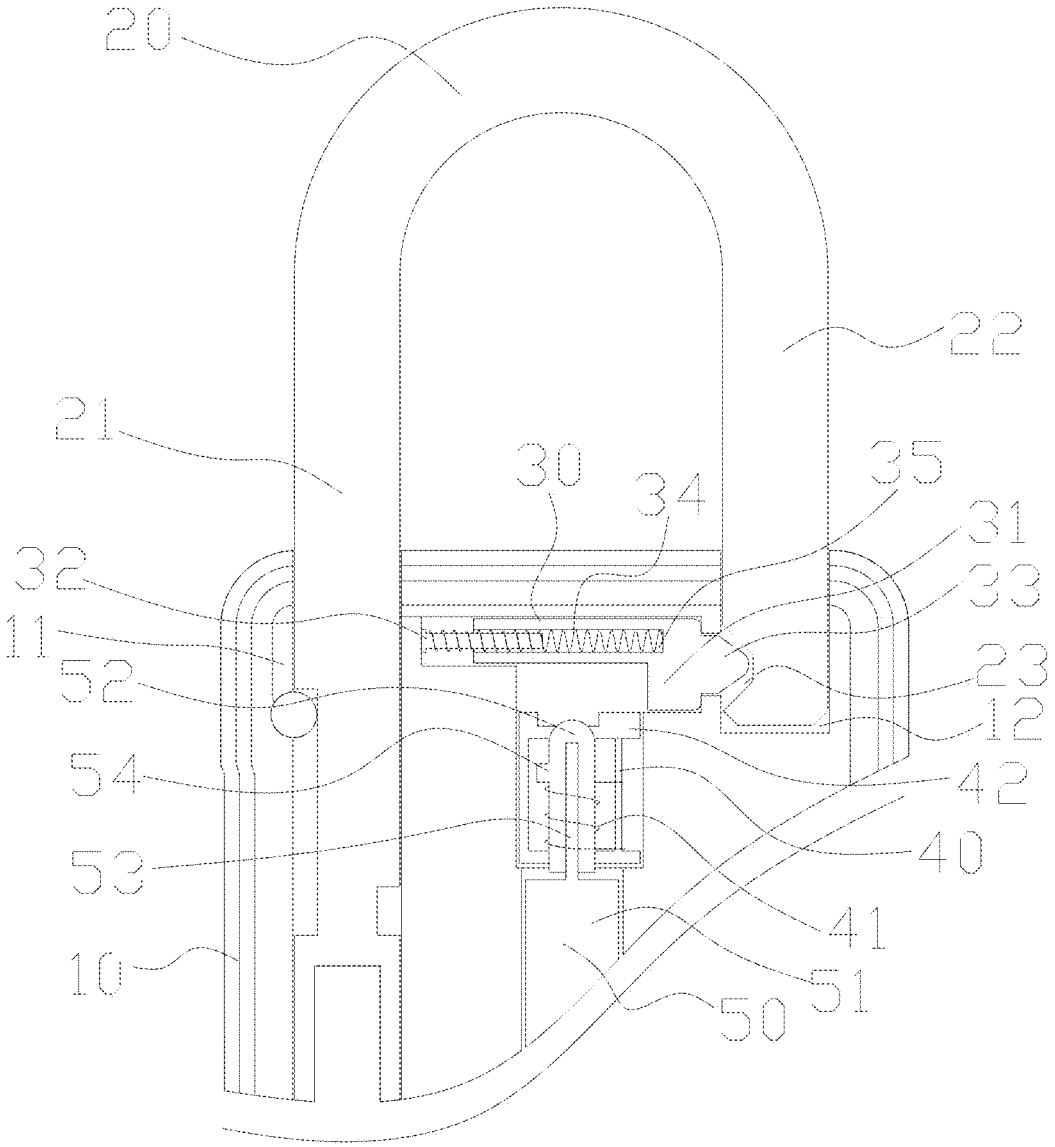
FIG. 2 is a schematic structural diagram showing an exemplary padlock in locked or incompletely unlocked situation according to one embodiment of the present invention.
Figure 3:
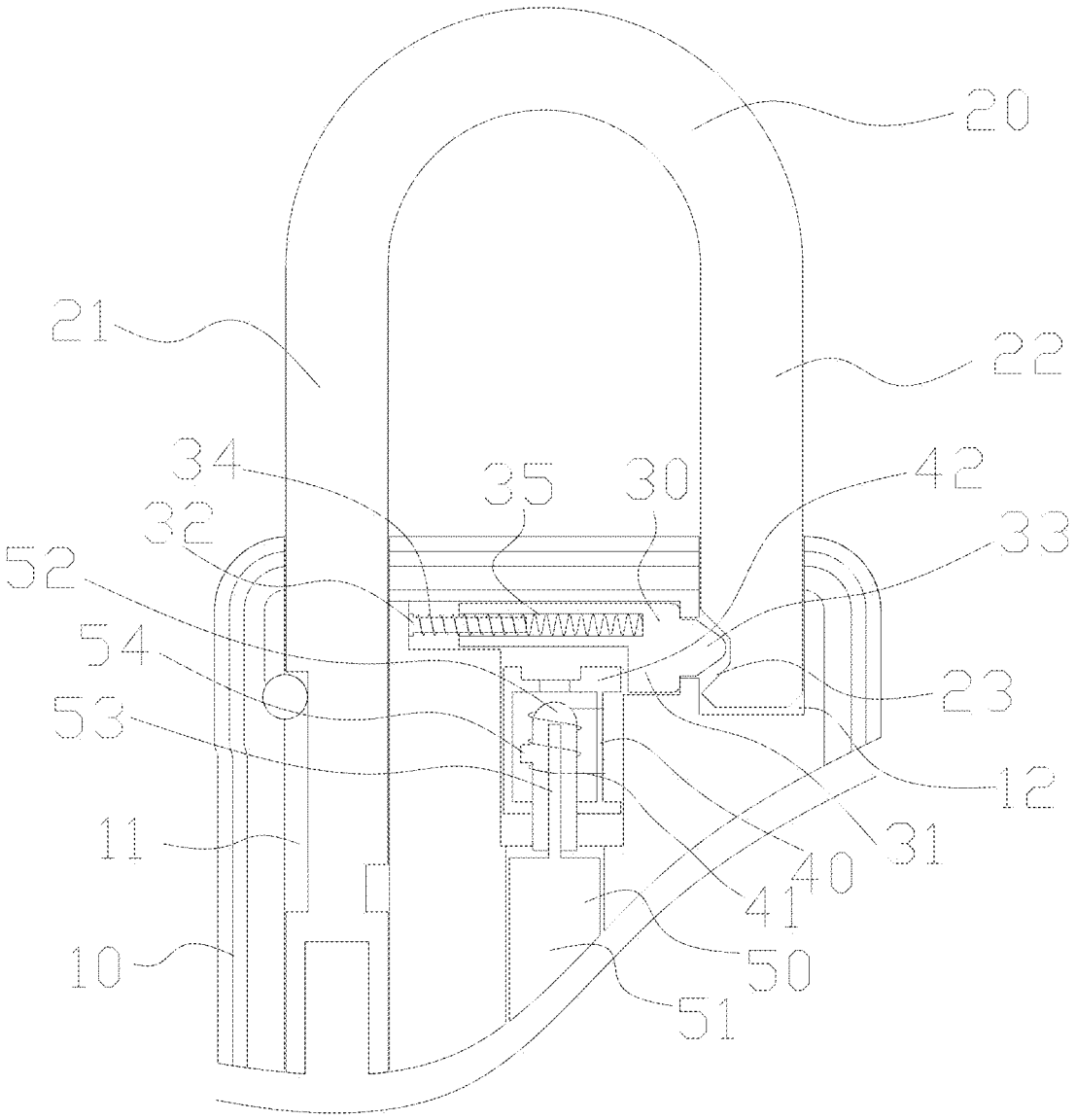
FIG. 3 is a schematic structural diagram showing the process of locking and unlocking an exemplary padlock according to one embodiment of the present invention.

The unlocked situation of this padlock is shown in FIG. 1. When the padlock is locked, the U-shaped latch hook 20 is pressed downward from the top, the short lock lever 22 is inserted into the short blind hole 12, and the end of the short lock lever 22 is in contact with the right end of the bolt 33. Due to the depression of the short lock lever 22, the bolt 33 will be compressed to the left end under the downward pressure from the short lock lever 22. With a continuously downward movement of the short lock lever 22, when the right end of the bolt 33 and the lock slot 23 of the short lock lever 22 reach a same horizontal level, the bolt 33 will rebound to the right due to the automatic rebound feature of the bolt 33 and the right end of the bolt unit 30 will be engaged into the lock slot 23, as shown in FIG. 2. At this time, the drive motor 51 starts to run and drive the drive lever 53 to rotate clockwise, which will cause the driving cap 52 and the lug boss 54 on its top to rotate clockwise. Because the space between adjacent coils of the first spring 41 matches the lug boss 54, the lug boss 54 is able to move inside or outside the threaded gap of the first spring 41. When the driving cap 52 rotates, as shown in FIG. 3, the first spring 41 moves upward due to the rotation of the lug boss 54, and the tumbler 42 connected to the first spring 41 also moves upward.

Figure 4:
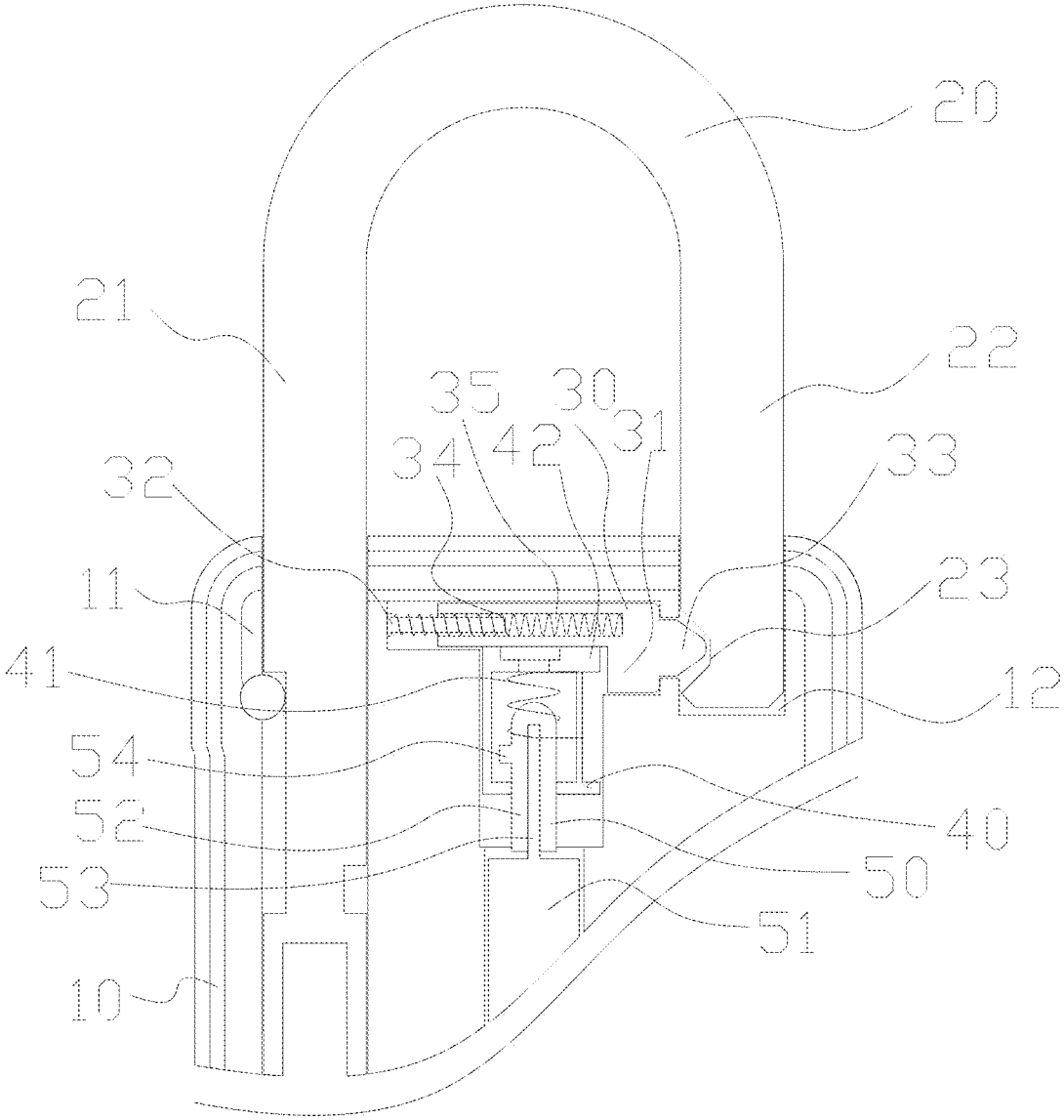
FIG. 4 is a schematic structural diagram showing an exemplary padlock in completely locked situation according to one embodiment of the present invention.

As shown in FIG. 4, when the tumbler 42 arrives at the left side of the stopper 31, since the distance between the lug boss 54 and the upper end of the driving cap 52 is greater than the length of first spring 41, the lug boss 54 will just rotate out of the first spring 41. Since the stopper 31 is limited by the displacement-limit function of tumbler 42, the bolt 33 cannot move leftward and will be restrained in the lock slot 23 of the short lock lever 22, which means that the padlock is locked. If a user fails to turn off the motor in time when the tumbler 42 is in place, even though the drive lever 53 will continue to rotate clockwise, because the lug boss 54 just rotates out of the first spring 41, the drive lever 53 will not continually drive the first spring 41 to move upward. As a result, the tumbler 42 will not continue to move upward and will not press the internal structures of the padlock.

The locked situation of this padlock is shown in FIG. 4. When the padlock is unlocked, the drive motor 51 starts to run and drive the drive lever 53 to rotate counter-clockwise, causing the driving cap 52 and the lug boss 54 on the top of the driving cap 52 to rotate counter-clockwise. Because the space between adjacent coils of the first spring 41 matches the lug boss 54, the lug boss 54 can move inside or outside the threaded gap of the first spring 41. As shown in FIG. 3, the first spring 41 will move downward due to the rotation of lug boss 54, and the tumbler 42 connected to the first spring 41 also moves downward. When the tumbler 42 arrives at a position far from the left side of the stopper 31, because the distance between the lug boss 54 and the lower end of the driving cap 52 is greater than the length of the first spring 41, as shown in FIG. 2, the lug boss 54 will just rotate out of the first spring 41. At this time, because the tumbler 42 moves far away from the left side of the stopper 31, the bolt 33 is able to move leftward. Meanwhile, when a user pulls up the U-shaped latch hook 20, due to the thrust action from the lock slot 23, the bolt 33 will move leftward, as shown in FIG. 1, and the short lock lever 22 can be pulled out of the short blind hole 12. After the short lock lever 22 is pulled out of the short blind hole 12, the bolt 33 automatically rebounds to the right to complete the padlock unlocking process. When the padlock is unlocked, in case that the user fails to timely turn off the motor while the tumbler 42 is in place, even though the drive lever 53 still continues to rotate counter-clockwise, since the lug boss 54 just rotates out of the first spring 41 and is unable to continually drive the first spring 41 to move downward, the tumbler 42 does not continue to move downward. As a result, the tumbler 42 will not press the internal structure of this padlock.

The padlock disclosed herein is easy to use. After a process of locking or unlocking is completed, in case that a user fails to turn off the motor in time when the tumbler 42 is in place, even though the drive lever 53 will continue to rotate, since the lug boss 54 just turns out of the first spring 41 and is unable to continually drive the first spring 41 to move up or down, the tumbler 42 will not continue to move up or down. Therefore, the tumbler 42 will not press the internal structure of this padlock, and then there is no "dead point" formed. This feature will make the internal structure of padlock not easy to be damaged. The padlock disclosed herein is reliable and durable, and has low use cost.

Preferably, in one embodiment as shown in FIGS. 1-4, the bolt unit 30 includes a pilot 32, the bolt 33, and a second spring 34 sleeved on the pilot 32; the left end of the pilot 32 is fixed on the internal side of lock body 10, and the right end is hung in the air. The left end of the bolt 33 has a mounting slot 35 cooperating with the pilot 32. The length of second spring 34 is larger than that of the pilot 32. The pilot 32 and the second spring 34 are inserted into the mounting slot 35. Because the length of second spring 34 is longer than that of the pilot 32, when the second spring 34 is in a still state, the left end of the second spring 34 is flush with the left end of the pilot 32. When the short lock lever 22 pushes the bolt 33 to the left and then compresses the second spring 34, the bolt 33 will move to the left along the pilot 32. When the short lock lever 22 stops pushing the bolt 33, the second spring 34 will rebound, which will lead the bolt 33 to move to the right along the pilot 32 to its original position automatically.

Preferably, as shown in FIGS. 1-4, the tumbler 42 is the shell-type tumbler 42 covering the driving cap 52. When the tumbler 42 moves right to the left side of the stopper 31, the shell-type tumbler 42 has a large volume, and the effect of limiting displacement provided by the stopper 31 will be better.

Preferably, as shown in FIGS. 1-4, the right end of the bolt 33 is arrow-head in shape, and the longitudinal section of the lock slot 23 is also arrow-head in shape matching the shape of the right end of the bolt 33. The bolt 33 has arrow-head shape to match the same shape of lock slot 23. The two ramps on the top and bottom of arrow head shape will facilitate the bolt 33 to clip into the lock slot 23 or slid out of the lock slot 23 when the short lever 22 is pulled up.

Finally, it should be noted that above embodiment is only intended to illustrate the technology solutions of the present invention rather than limits the scope of protection for the present invention. Although there are detailed descriptions about the present invention referred to a better embodiment, the common technical personnel in this field should understand that any modification and equivalent replacement made on the technology solutions of the present invention shall not be out of the substance and scope of technology solutions of the present invention.

While the present invention has been disclosed with references to certain embodiments, numerous modification, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A padlock comprising:

a lock body and a U-shaped latch hook;

wherein said U-shaped latch hook includes a long lock lever and a short lock lever, said lock body having a long blind hole and a short blind hole, said long lock lever being disposed inside of said long blind hole, said short lock lever being loosely inserted into said short blind hole, and a lock slot being disposed on a left side of said short lock lever;

wherein a bolt unit, a brake unit being able to move up-and-down, and a drive unit being able to drive said brake unit to move up-and-down are disposed inside said lock body;

wherein said bolt unit is configured to be able to automatically rebound after being compressed to a left end, the left end of said bolt unit being fixed inside of said lock body, a right end being able to clip in said lock slot; and said bolt unit having a stopper;

wherein said drive unit comprises a drive motor and a driving cap, and said drive motor has a drive lever being able to rotate clockwise and counter-clockwise; said driving cap being fixedly sleeved on said drive lever, and a lug boss being disposed on an external side of said driving cap; and wherein said brake unit includes a first spring sleeved on said driving cap and a tumbler fixedly connected to said first spring; a space between adjacent coils of said first spring matching said lug boss, so that said lug boss being able to move inside or outside a threaded gap of said first spring; said tumbler being located to the left side of said stopper and cooperating with said stopper to limit displacement provided by the stopper based on a rotation of said drive lever, a distance between said lug boss and an upper end and/or a lower end of said driving cap being greater than a length of said first spring.

2. The padlock as set forth in claim 1, wherein said bolt unit includes a pilot, a bolt, and a second spring sleeved on said pilot; the left end of said pilot being fixed on the internal side of said lock body; the left end of said bolt having a mounting slot cooperating with said pilot; a length of said second spring being greater than that of said pilot; and said pilot and said second spring being inserted into said mounting slot.

3. The padlock as set forth in claim 1, wherein said tumbler is a shell-type tumbler sleeved said driving cap.

4. The padlock as set forth in claim 2, wherein the right end of said bolt is arrow-head in shape, and a longitudinal section of said lock slot is also arrow-head in shape matching the shape of said right end of said bolt.

* * * * *